United States Patent [19]

Horton

[11] 4,350,204

[45] Sep. 21, 1982

[54] REAMER

[76] Inventor: Gary B. Horton, 4514 Palmetto Dr., Benton, La. 71006

[21] Appl. No.: 157,867

[22] Filed: Jun. 9, 1980

[51] Int. Cl.[3] ..... E21B 37/02

[52] U.S. Cl. ..... 166/175; 166/176; 175/323; 175/406

[58] Field of Search ..... 166/170, 174, 175, 176, 166/177, 237; 175/319, 323, 322, 325, 406; 74/89.15, 127

[56] References Cited

U.S. PATENT DOCUMENTS

| | | | |
|---|---|---|---|
| 1,479,132 | 1/1924 | Gianella | 175/322 |
| 1,497,479 | 6/1924 | Booth | 74/127 |
| 2,145,190 | 1/1939 | Nay | 166/174 |
| 2,679,905 | 6/1954 | Mangum et al. | 166/175 |
| 2,728,556 | 12/1955 | House | 74/89.15 |
| 2,980,423 | 4/1961 | Parkhurst | 46/68 |

*Primary Examiner*—James A. Leppink

[57] ABSTRACT

A reamer for removing paraffin, scale, ice and other accumulations from the inside surfaces of oil well pump tubing and casing which includes a hollow, tapered shell or housing fitted with external blades and having an enlarged upper internal bore area to accommodate a threaded lock nut, and a threaded shaft projecting into the housing cavity in threadable cooperation with the lock nut and provided with stops to permit limited rotation of the shell on the shaft and to prevent the shaft from exiting the shell when fully extended from the shell on the lock nut. When the reamer is lowered by means of a wire line and swivel joint into a length of tubing or casing to the constricted area, and the shaft is extended in the shell, a repetitive impact load on the projecting end of the shaft effects rotation of the shell and blades on the shaft to remove the deposits. When the shell rotatably progresses to a fully threaded position on the shaft responsive to the impact load, upward pressure is then exerted on the shaft by means of the wire line, and the shaft rotates upwardly on the lock nut to the former position of full extension in the shell, where the load is again applied. A threaded shaft and cooperating lock nut for either clockwise or counter-clockwise rotation of the tapered shell can be used in the reamer, and the blades can be removed and the counter-clockwise shell rotation used to loosen tubing in the well.

14 Claims, 10 Drawing Figures

REAMER

BACKGROUND OF THE INVENTION

1. Field of the Invention

This invention relates to oil well cleaning apparatus, and more particularly, to a reamer tool for scraping and removing paraffin, scale, ice and other accumulations from the inside surfaces of oil well tubing and casing. The reamer tool of this invention is designed to operate in cooperation with a wire line fitted with a swivel joint, and a load application means such as one or more spanner jars for alternately applying a repetitive impact load to the tool and repositioning a component part of the tool for further load application.

The problem of restricted flow in oil wells due to the accumulation of paraffin and other deposits on the inside wall of the tubing is one of great concern in the oil field. Paraffin accumulation sometimes occurs in a relatively short period of time and can form a tough, semi-solid deposit which severly restricts the flow of fluid in the tubing. Accumulation thickness and character varies with the type and quantity of oil and hydrocarbon fluid produced and frequently causes severe stress in pumping apparatus and equipment, with resulting equipment failure or low operating efficiency. Typically, the accumulation of paraffin deposits in oil well production tubing occur at a point where the hydrostatic pressures and temperatures create favorable conditions for precipitation of solid paraffin from the oil. Other deposits such as rust, scale and ice must frequently be removed from production tubing and casing, particularly in corrosive environments, and in the case of ice, in regions of prolonged low temperature.

DESCRIPTION OF THE PRIOR ART

Paraffin and other deposit accumulations in production tubing are frequently removed by using expensive and sometimes complicated scraping tools which may be attached to the sucker rods deployed in the well. This technique is time consuming and expensive since the sucker rod string must first be removed, the paraffin scraper tool or tools then installed on the sucker rods, the rods and accompanying scraping tools reinserted in the well, the scraping operation completed and the tools finally removed. Such a procedure can be prohibitively expensive in some wells and impractical in others, and the tools sometimes break and become jammed in the tubing. Furthermore, accumulation of paraffin and asphalt in the tubing sometimes becomes too thick for removal by application of such equipment, and the tubing string must be pulled out of the well and "burned" in order to remove the accumulated deposits. This procedure is extremely time consuming and expensive, and is normally used only as a last resort when conventional tools cannot be used effectively.

Another technique frequently used to remove deposits from tubing includes pulling and disconnecting a sufficient number of sucker rods to facilitate insertion of a "hook and washer" type cleaning tool to the point of deposit accumulation, and subsequently pulling the tool out of the tubing to scrape the deposit loose. This technique is also time consuming, and is relatively inefficient and expensive.

Accordingly, there is a need for, and it is an object of this invention to provide, a new and improved reamer for removing deposits and accumulations of paraffin, asphalt, scale, ice and other materials from the inside surfaces of oil well tubing and casing, which reamer includes a shell or housing fitted with external blades and threadably mounted on a shaft, and designed for use with a wire line fitted with a swivel joint and provided with a hammer means such as a spanner jar for alternately applying a repetitive impact load to the shaft in order to force rotation of the housing and blades against a deposit in the tube, and rotatably displacing and repositioning the shaft inside the housing by means of the wire line and swivel joint.

Another object of the invention is to provide a simple and inexpensive reamer for oil field tubing and casing which can be lowered into the tubing or casing by means of a wire line equipped with a swivel joint and provided with a hammer means such as one or more spanner jars, to alternatively and repetitively load the reamer and displace the impact member for continued repetitive loading.

Yet another object of this invention is to provide a new and improved casing and tubing reamer which is not required to be attached to the sucker rods for operation, and which is characterized by a rotating housing fitted with external blades which are capable of reaming the entire well in a single, continuous operation utilizing only a wire line fitted with a swivel joint, and a cooperating hammer means, such as a spanner jar.

A still further object of the invention is to provide a reamer for removing accumulations of paraffin, scale, ice and other material from oil well tubing and casing, which reamer is characterized by a housing rotatably mounted on a threaded shaft and provided with blades, which reamer is capable of being dismantled and parts replaced as desired in a short period of time.

Another object of the invention is to provide a rotatable reamer for removing paraffin, scale, ice and other accumulations from the inside surfaces of oil well pump tubing and casing which includes a hollow, tapered housing fitted with external blades and having an enlarged upper internal bore area to accommodate a threaded lock nut, and a threaded shaft projecting into the housing cavity in threadable cooperation with the lock nut to permit the housing and blades to rotate on the shaft in either the clockwise or counter-clockwise direction, depending upon the choice of lock nut and threaded shaft, responsive to a repetitive impact load on the shaft.

Yet another object of the invention is to provide a reamer for oil field casing and tubing which is capable of running fishing tools in addition to removing accumulations of paraffin, scale, ice and other material from oil well tubing and casing.

SUMMARY OF THE INVENTION

A reamer for removing paraffin, scale, ice and other accumulations from the inside surfaces of oil well pump tubing and casing which is characterized by a hollow, tapered shell or housing fitted with external blades and having an enlarged upper internal bore area to accommodate a threaded lock nut, and fitted with a threaded shaft projecting into the housing cavity in threadable cooperation with the lock nut. The threaded shaft is also provided with stops to permit limited rotation of the housing on the shaft and to prevent the shaft from exiting the housing when fully extended from the housing on the lock nut. When the reamer is lowered by means of a wire line and swivel joint into a length of tubing or casing to the constricted area and the shaft is extended in the housing, a repetitive impact load on the projecting end of the shaft effects rotation of the housing and blades on the shaft to remove the deposits. When the housing rotatably progresses to a fully threaded position on the shaft responsive to the impact load, upward pressure is then exerted on the shaft by means of the wire line and the shaft rotates upwardly on the lock nut by operation of the swivel joint to the former position of full extension in the housing, where the load is again applied. The reamer can be operated with a threaded shaft and cooperating lock nuts having right and left-handed threads, respectively, to achieve both clockwise and counter-clockwise rotation of the housing and blades, or the housing without the blades, where it is desired to loosen tubing in the well.

BRIEF DESCRIPTION OF THE DRAWINGS

This invention will be better understood by reference to the accompanying drawings, wherein.

DESCRIPTION OF THE PREFERRED EMBODIMENTS

Figure 1:
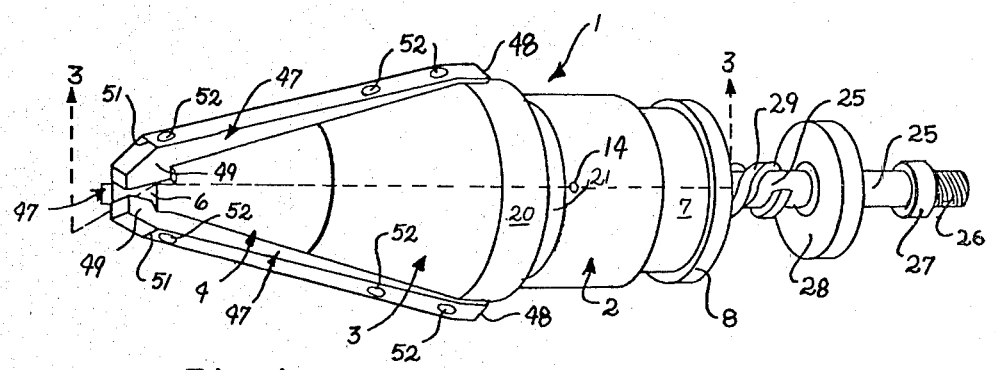
FIG. 1 is a perspective view of the reamer of this invention with the shaft in partially extended position.
Figure 5:
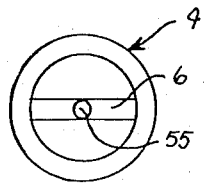
FIG. 5 is a bottom elevation of a bottom housing provided with a sucker rod receptacle facilitating use of the reamer as a device for running fishing tools.
Figure 2:
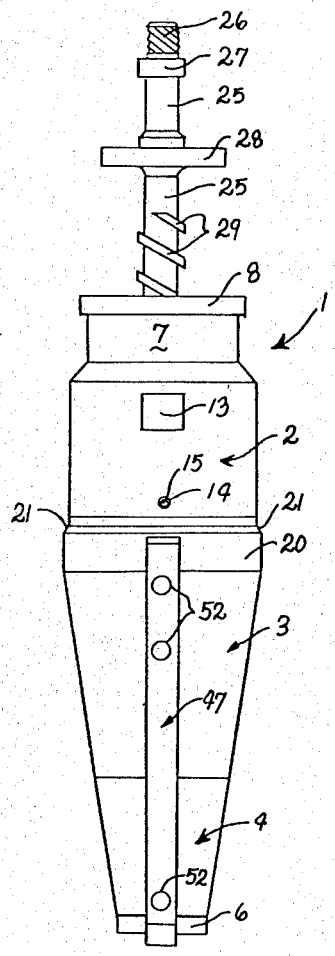
FIG. 2 is a side elevation of the reamer illustrated in FIG. 1.
Figure 6:
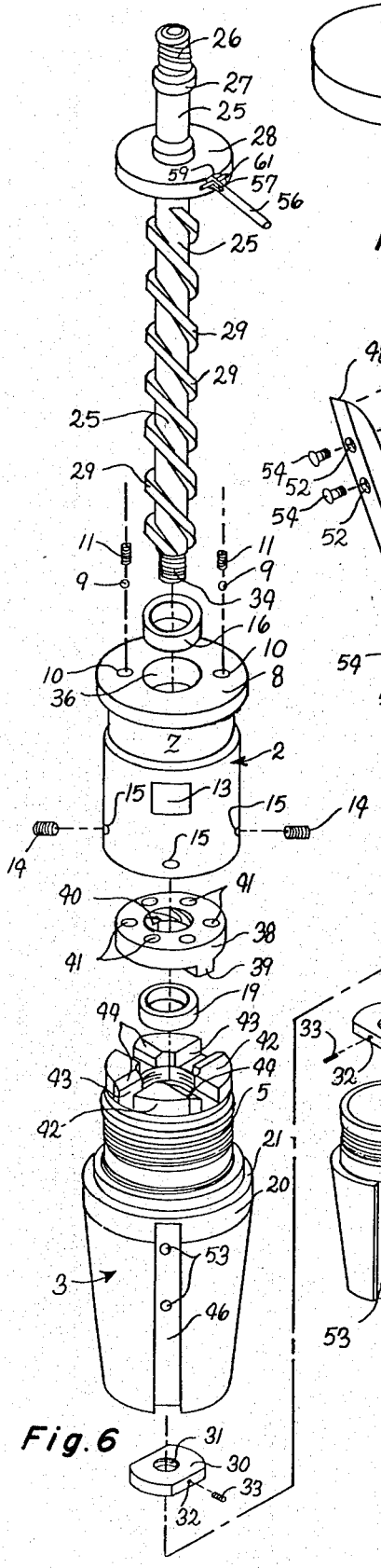
FIG. 6 is an exploded view of the reamer illustrated in FIGS. 1–4 with the reamer blades removed to further define a preferred technique of blade attachment.

Referring now to FIGS. 1, 2 and 6 of the drawings, the reamer of this invention is generally illustrated by reference numeral 1, and in a preferred embodiment, includes a top housing 2, a middle housing 3 and a bottom housing 4, which are removably attached to each other, respectively, by means of housing threads 5, as illustrated in FIG. 6. Removal of top housing 2 from middle housing 3, and middle housing 3 from bottom housing 4 is achieved by applying wrenches to bottom housing lug 6 and wrench flats 13 to unscrew the respective housing members on housing threads 5. Top housing 2 is removably secured to middle housing 3 by means of top housing set screws 15, which are positioned in top housing set screw apertures 14, as illustrated in FIG. 2. Top housing 2 is further provided with a top housing collar 7, which is capped by a top housing flange 8, provided with a top housing flange aperture 36, as also illustrated in FIG. 5. Similarly, middle housing 3 is provided with middle housing aperture 37 at the top of middle housing 3, and with middle housing collar 20 and middle housing shoulder 21, on the exterior of middle housing 3.

Figure 3:
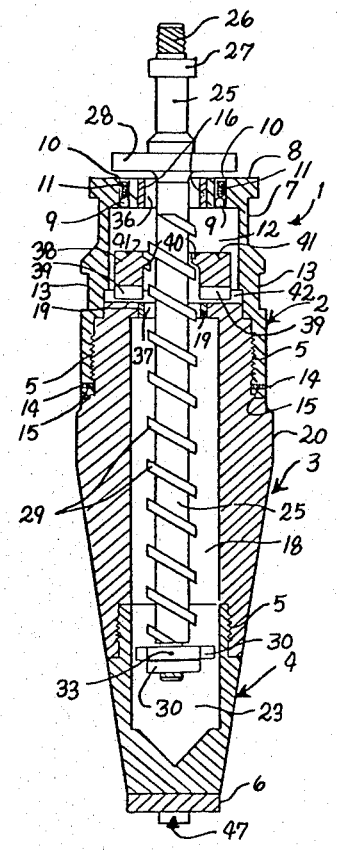
FIG. 3 is a sectional view taken along lines 3—3 in FIG. 1, more particularly illustrating the reamer with the shaft in closed configuration within the housing or shell.
Figure 4:
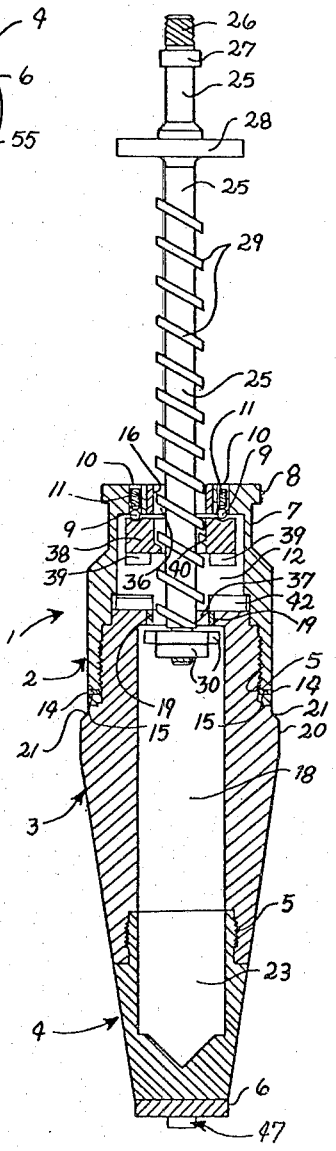
FIG. 4 is a sectional view taken along lines 3—3 in FIG. 1, more particularly illustrating the shaft in extended configuration from the housing.

Referring now specifically to FIGS. 3, 4 and 6 of the drawings, a shaft 25, provided with shaft threads 29, is inserted in top housing flange aperture 36 of top housing flange 8, and projects through top housing flange aperture 36 into top housing cavity 12, and through middle housing aperture 37 into middle housing cavity 18, and into bottom housing cavity 23 when in fully closed position, as illustrated in FIG. 3. Shaft 25 is further provided with connector threads 26 at the upper end, and a connector flange 27 located immediately beneath connector threads 26. The opposite end of shaft 25 is fitted with lock nut shaft threads 34, as more particularly illustrated in FIG. 6, in order to accommodate a pair of shaft lock nuts 30, provided with lock nut threads 31, and also fitted with lock nut set screw apertures 32 and lock nut set screws 33, for securing shaft lock nuts 30 on lock nut shaft threads 34, as illustrated in FIGS. 3 and 4. It will be appreciated by those skilled in the art that in a preferred embodiment of the invention shaft lock nuts 30 are brass and are threaded so as to lock on lock nut shaft threads 34 in 90 degree, off-set configuration, as illustrated in FIGS. 3 and 4. When so positioned on lock nut shaft threads 34, shaft lock nuts 30 are fitted with lock nut set screws 33, which are tightened to secure the shaft lock nuts 30. As particularly illustrated in FIG. 4 of the drawings, the top one of shaft lock nuts 30 contacts the upper interior surface of middle housing 3 to prevent shaft 25 from exiting top housing 2 and middle housing 3 when shaft 25 is in the fully extended position as shown. Shaft 25 is maintained in vertical configuration inside top housing cavity 12, middle housing cavity 18 and bottom housing cavity 23 by means of top housing bushing 16, positioned in top housing flange aperture 36, and middle housing bushing 19, which is positioned in middle housing cavity 18, as illustrated in FIGS. 3, 4 and 6. A lock nut 38, which is provided with a pair of lock nut lugs 39 projecting downwardly, and fitted with lock nut threads 40, is provided in top housing cavity 12, for threadable cooperation with shaft threads 29 of shaft 25. Lock nut 38 is free to threadably move up and down on shaft 25 inside top housing cavity 12 responsive to the movement of shaft 25 from the fully extended configuration of shaft 25, illustrated in FIG. 4, to the closed position shown in FIG. 3. A lock nut lug seat 42 is provided in top housing cavity 12 at the top end of middle housing 3, and is fitted with at least two lug seat slots 43, which are, in a preferred embodiment of the invention, provided with lug seat bevels 44, as particularly illustrated in FIG. 6. Lug seat slots 43 are designed to receive lock nut lugs 39 of lock nut 38 when lock nut 38 is seated on lock nut lug seat 42, as shaft 25 is positioned in the closed configuration illustrated in FIG. 3. In yet another preferred embodiment of the invention, lug seat slots 43 are slightly deeper than lock nut lugs 39 in order to prevent lock nut lugs 39 from touching the bottom of lock nut lug seat 42.

Referring again to FIGS. 3, 4 and 6 of the drawings, a plurality of ball bearings 9 are provided in ball bearing apertures 10, located in top housing flange 8, and are mounted to project into top housing cavity 12 as illustrated in FIGS. 3 and 4. In a preferred embodiment of the invention ball bearings 9 are biased to partially project into top housing cavity 12 by means of springs 11, in order to mate with cooperating lock nut ball bearing seats 41, provided in the top surface of lock nut 38, as further illustrated in FIGS. 3, 4 and 6. As heretofore noted, the extension of shaft 25 from top housing 2, middle housing 3 and bottom housing 4 is limited by contact between shaft lock nuts 30 and the top inside surface of middle housing cavity 18. In like manner, the retraction or closing of shaft 25 inside top housing 2, middle housing 3 and bottom housing 4 is limited by a shaft flange 28, which is provided on shaft 25 as illustrated. In a preferred embodiment of the invention shaft flange 28 is formed integrally with shaft 25 for maximum strength.

Figure 7:
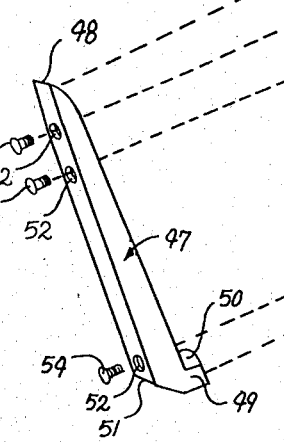
FIG. 7 is a perspective view of the reamer in partially exploded configuration, further illustrating a preferred attachment of the blades.
Figure 7:
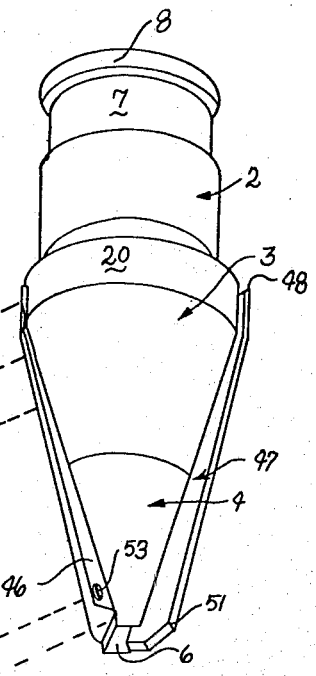
Figure 8:
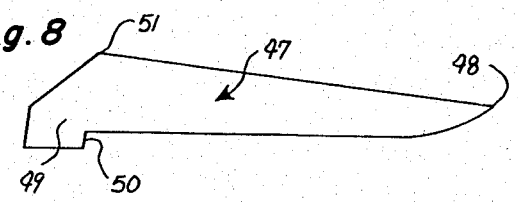
FIG. 8 is a side elevation of a preferred blade for use on the reamer of this invention.
Figure 9:
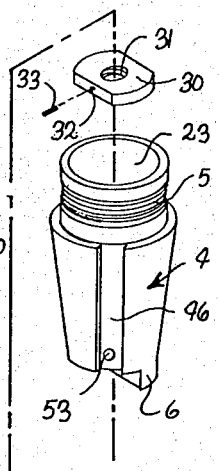
FIG. 9 is a bottom elevation of the reamer illustrated in FIGS. 1–7.
Figure 9:
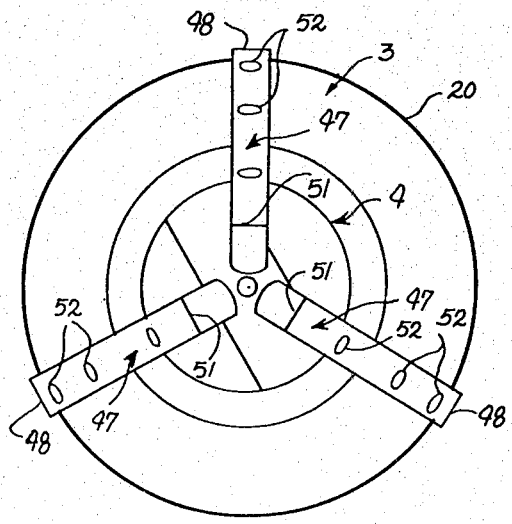

Referring now to FIGS. 1, 2, 7 and 8, top housing 2, middle housing 3 and bottom housing 4 are provided with a plurality of blade slots 46, which are tapered in depth to receive blades 47, which are, in a preferred embodiment of the invention, heat treated for maximum hardness and strength. Blades 47 are configured with a blade tip 48, a blade base 49, having a blade base shoulder 50 and a blade base head 51, as more particularly illustrated in FIG. 8 of the drawing. Blade base shoulder 50 is designed to mate with the bottom surface of bottom housing lug 6, as illustrated in FIGS. 1 and 7 of the drawings, in order to stabilize blades 47 in blade slots 46. Blade apertures 52 register with blade slot apertures 53, provided in the base of top housing 2, middle housing 3 and bottom housing 4, in order to permit blade bolts 54 to secure blades 47 to top housing 2, middle housing 3 and bottom housing 4, as illustrated in FIG. 7 of the drawings. In a preferred embodiment of the invention the taper of top housing 2, middle housing 3 and bottom housing 4 is about 20 degrees, while the taper of blades 47 is about 10 degrees. This configuration permits the blade base head 51 and top edge of blades 47 to most efficiently contact and cut the residue material in casings and tubings at maximum efficiency.

Figure 10:
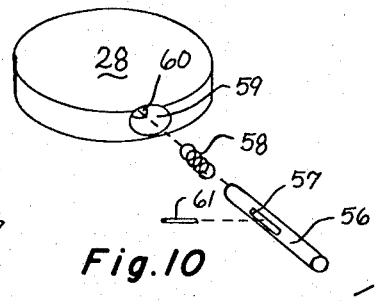
FIG. 10 is an exploded view of a preferred stabilizing pin and mount.

Referring to FIGS. 6 and 10 of the drawings, in a preferred embodiment of the invention shaft flange 28 is provided with a flared stabilizing pin aperture 59 having a stabilizing pin seat in the base thereof, for receiving a spring 58 and a stabilizing pin 56. A pin slot 57, provided in stabilizing pin 56, is designed to slidably receive a flange pin 61, the ends of which are bradded to shaft flange 28. Accordingly, stabilizing pin 56 is free to contact the side of a length of tubing or casing when reamer 1 is lowered into the pipe, and stabilizes the reamer during use. The stabilizing pin 56 is free to depress farther into stabilizing pin aperture 59 against the bias of spring 58, and to move up, down or to either side responsive to contact with the wall of the casing or tubing to prevent jamming of reamer 1 in the pipe during insertion or removal.

Referring again to the drawings, in operation, reamer 1 is utilized as follows. One or more spanner jars are threadably connected to connector threads 26 of shaft 25, and a wire line having a swivel joint (not illustrated) is attached to the opposite end of the spanner jar string. Reamer 1 is then lifted by means of the wire line into position with shaft 25 fully extended from top housing 2, middle housing 3 and bottom housing 4 as illustrated in FIG. 4 of the drawing. The reamer 1, spanner jar or jars, and wire line are then lowered into a casing or tubing string until the reamer is prevented from further penetration by the accumulation or deposit of paraffin, scale, ice or the like. At this point, the wire line and spanner jar assembly are lifted until the spanner jars are raised to maximum position above reamer 1, after which the spanner jars are allowed to drop and impact on connector flange 27 of shaft 25. This impact initially causes lock nut 38 to rotatably traverse shaft threads 29 of shaft 25 and lock nut lugs 39 to engage lug seat slots 43 of lock nut lug seat 42, and effect clockwise rotation of top housing 2, middle housing 3 and bottom housing 4, when a shaft 25 and lock nut 38 having right-hand threads are used in reamer 1. This action effects removal of the deposits which are adjacent blades 47 due to the rotation of reamer 1. After the initial impact between the spanner jar or jars and the top of shaft 25, the spanner jar is again lifted by means of the wire line and subsequently again caused to impact on the top of shaft 25, thus effecting additional rotation of reamer 1 and additional contact between blades 47 and the accumulated deposits to effect removal of the deposits. This repetitive lifting and dropping of the spanner jars to achieve impact between the spanner jars and shaft 25 is continued until shaft 25 is closed inside top housing cavity 12, middle housing cavity 18 and bottom housing cavity 23 and shaft flange 28 contacts top housing flange 8, as illustrated in FIG. 3 of the drawings. When this configuration of reamer 1 is reached, the wire line is again placed in tension, the spanner jars are lifted and shaft 25 is rotatably displaced from its position in top housing 2, middle housing 3 and bottom housing 4, as illustrated in FIG. 4, to permit the process to be repeated. It will be appreciated from a consideration of FIGS. 4 and 5 of the drawings, that when shaft 25 is extended from top housing 2, middle housing 3 and bottom housing 4 as illustrated in FIG. 4, that lock nut 38 rotates upwardly against the inside surface of top housing flange 8 with lock nut ball bearing seats 41 registering with ball bearings 9 to prevent lock nut 38 from rotating further as shaft 25 extends to its maximum position with the top one of shaft lock nuts 30 adjacent the top end of middle housing cavity 18. Rotation of shaft 25 with respect to the wire line is achieved by means of the swivel, which attaches the wire line to the spanner jar, to prevent the wire line from twisting.

It will be appreciated by those skilled in the art that reamer 1 can be used to unseat and unthread tubing and casing in addition to operating as a reamer. For example, referring again to FIG. 6 of the drawings, a shaft 25 having left-hand threads and a cooperating lock nut 38 can be installed in reamer 1 in place of the illustrated shaft and lock nut. This replacement causes blades 47 to move in a counter-clockwise direction when reamer 1 is operated as described above. Accordingly, if it is desired to unscrew one length of tubing from another while both are suspended in the well hole, the reamer can be securely lodged in the tubing section to be removed, and the hammer jars and wire line utilized as described above to loosen and unseat the tubing.

It will be further understood that the reamer of this invention can function as a fishing tool runner by use of the bottom housing 4 illustrated in FIG. 5. In this embodiment of the invention blades 47 can be removed from reamer 1 as illustrated in FIG. 6, and the bottom housing 4 shown in FIG. 5 screwed onto middle housing 3. This version of bottom housing 4 is provided with an internally threaded sucker rod receptacle 55 in bottom housing lug 6 and the base of bottom housing 4 to receive an "overshot" having a male fitting adapted for threadable cooperation with sucker rod receptacle 55. A wire line and fishing tool can be suspended from the overshot to effect fishing operations, and the rotational motion of reamer 1 responsive to hammer jar impact can be used to free immobilized tubing, casing, tool and the like in the hole.

Referring again to the drawings, a still further attribute of the reamer of this invention is connector flange 27, which can be used to retrieve reamer 1 in the event that it is lost in the well hole. Conventional "fishing" devices known to those skilled in the art can be used to grasp the connector flange 27 for retrieval of the reamer.

Having described my invention with the particularity set forth above, what is claimed is:

1. A reamer for use with a wire line in the loosening of oil well tubing and casing comprising:

(a) a housing having a hollow interior and an opening in the top thereof communicating with said hollow interior;

(b) a shaft extending through said opening and into said hollow interior and provided with external shaft threads turned in the opposite direction from the tubing and casing threads;

(c) stop means on the end of said shaft projecting into said hollow interior to limit the travel of said shaft and coupling means on the outside end of said shaft extending from said hollow interior for attaching said outside end of said shaft to the wire line;

(d) a lock nut disposed in said hollow interior and having at least one lock nut lug on the bottom face thereof, and provided with internal lock nut threads in threadable cooperation with said shaft threads on said shaft; and (e) at least on lug seat provided in said hollow interior beneath said lock nut for registration with said at least one lock nut lug to effect rotation of said lock nut and said housing on said shaft when a load is applied to said shaft.

2. The reamer of claim 1 wherein said coupling means is external shaft threads.

3. The reamer of claim 1 wherein said housing further comprises a top housing, a middle housing in threadable cooperation with said top housing, and a bottom housing in threadable cooperation with said middle housing.

4. The reamer of claim 1 further comprising a stabilizing pin mounted in pivotal relationship to a portion of said shaft extending outside said hollow interior to contact the inside surface of said tubing and casing and stabilize said reamer when said load is applied to said shaft.

5. The reamer of claim 1 wherein said housing further comprises a top housing, a middle housing in threadable cooperation with said top housing, and a bottom housing in threadable cooperation with said middle housing, and said coupling means is external shaft threads.

6. A reamer for suspension from a wire line and swivel and rotatably cleaning the inside surfaces of oil well tubing and casing comprising:

(a) a housing having a hollow interior and an opening in the top thereof communicating with said hollow interior;

(b) a shaft extending through said opening and into said hollow interior and provided with external shaft threads and a coupling means for attachment to said wire line;

(c) stop means on the end of said shaft projecting into said hollow interior and on that portion of said shaft extending from said hollow interior and said opening to prevent said shaft from exiting said hollow interior and said opening and limiting the travel of said shaft;

(d) a lock nut disposed in said hollow interior and having at least one lock nut lug on the bottom face thereof and provided with internal lock nut threads in threadable cooperation with said shaft threads on said shaft;

(e) at least one lug seat provided in said hollow interior beneath said lock nut for registration with said at least one lock nut lug and effecting rotation of said lock nut and said housing on said shaft when said reamer is lowered into said oil well tubing and casing and a repetitive load is applied to said portion of said shaft extending from said hollow interior; and (f) a plurality of blades removably mounted on said housing for scraping and cleaning said inside surfaces of said tubing and casing responsive to rotation of said housing.

7. The reamer of claim 6 wherein said stop means on that portion of said shaft extending from said hollow interior and said opening is a round shaft flange.

8. The reamer of claim 7 further comprising a stabilizing pin mounted in pivotal relationship on said shaft flange to contact the inside surface of said tubing and casing and stabilize said reamer when said load is applied to said shaft.

9. The reamer of claim 6 wherein said housing is shaped substantially in the configuration of a truncated cone and further comprises a top housing, a middle housing and a bottom housing in threadable cooperation, respectively.

10. The reamer of claim 6 wherein said housing is shaped substantially in the configuration of a truncated cone and further comprises a top housing, a middle housing and a bottom housing in threadable cooperation, respectively, and said stop means on that portion of said shaft extending from said hollow interior and said opening is a round shaft flange; and further comprising a stabilizing pin mounted in pivotal relationship on said shaft flange to contact the inside surface of said tubing and casing and stabilize said reamer when said load is applied to said shaft.

11. The reamer of claim 6 further comprising a bushing mounted in said opening and in said hollow interior below said at least one lug seat to facilitate smooth, threaded travel of said lock nut on said shaft.

12. The reamer of claim 6 further comprising bearing seats in the top surface of said lock nut, and cooperating bearings provided in the top interior surface of said housing and projecting into said hollow interior for registration with said bearing seats when said wire line and said swivel are lifted and said shaft and said lock nut are forced upwardly, with said shaft extending in rotatable, threaded relationship on said lock nut to full extension from said hollow interior and said opening.

13. The reamer of claim 6 wherein said housing is shaped substantially in the configuration of a truncated cone, and further comprises a top housing, a middle housing and a bottom housing in threadable cooperation, respectively, and said stop means on that portion of said shaft extending from said hollow interior and said opening is a round shaft flange and further comprising:

(a) a stabilizing pin mounted in pivotal relationship on said shaft flange to contact the inside surface of said tubing and casing and stabilize said reamer when said load is applied to said shaft;

(b) a bushing mounted in said opening and in said hollow interior below said at least one lug seat to facilitate smooth, threadable travel of said lock nut on said shaft; and (c) bearing seats in the top surface of said lock nut and cooperating bearings provided in the top interior surface of said housing and projecting into said hollow interior for registration with said bearing seats when said wire line and said swivel are lifted and said shaft and said lock nut are forced upwardly, with said shaft extending in rotatable, threaded relationship on said lock nut to full extension from said hollow interior and said opening.

14. The reamer of claim 6 wherein said bottom housing is provided with a threaded aperture for attachment to a sucker rod.

* * * * *